US008228005B2

(12) United States Patent
Ohtaka et al.

(10) Patent No.: US 8,228,005 B2
(45) Date of Patent: Jul. 24, 2012

(54) LIGHT-EMITTING-ELEMENT DRIVING CIRCUIT

(75) Inventors: Nobuyuki Ohtaka, Kadoma (JP); Tomoshi Yoshida, Nishinomiya (JP)

(73) Assignee: Semiconductor Components Industries, LLC, Phoenix, AZ (US)

( * ) Notice: Subject to any disclaimer, the term of this patent is extended or adjusted under 35 U.S.C. 154(b) by 176 days.

(21) Appl. No.: 12/848,396

(22) Filed: Aug. 2, 2010

(65) Prior Publication Data

US 2011/0025234 A1 Feb. 3, 2011

(30) Foreign Application Priority Data

Jul. 31, 2009 (JP) ..... 2009-179471

(51) Int. Cl.
*H05B 37/02* (2006.01)

(52) U.S. Cl. ..... 315/307; 315/193; 315/313

(58) Field of Classification Search ..... 315/185 R, 315/193, 209 R, 291, 294, 297, 210, 307, 315/308, 312, 313
See application file for complete search history.

(56) References Cited

U.S. PATENT DOCUMENTS 6,825,619 B2 * 11/2004 Norris ..... 315/149
7,919,928 B2 * 4/2011 Ziegenfuss ..... 315/227 R
7,986,108 B2 * 7/2011 Yinn et al. ..... 315/297
8,120,263 B2 * 2/2012 Lin et al. ..... 315/209 R

FOREIGN PATENT DOCUMENTS

JP 2005-11895 A 1/2005

* cited by examiner

*Primary Examiner* — James H Cho
(74) *Attorney, Agent, or Firm* — Cantor Colburn LLP

(57) ABSTRACT

A light-emitting-element driving circuit is provided which comprises a voltage boosting circuit unit which supplies a boosted voltage to a light-emitting element, a current circuit unit which drives the light-emitting element with a current, a normal feedback loop path through which a voltage of the light-emitting element is input as a feedback voltage to the voltage boosting circuit unit, a backup feedback loop path through which a voltage of the light-emitting element is input as the feedback voltage to the voltage boosting circuit unit, an abnormality detection circuit unit which compares the feedback voltage which is input through the normal feedback loop path to the voltage boosting circuit unit and a predetermined determination voltage, to detect abnormality, and a switching circuit which switches from the normal feedback loop path to the backup feedback loop path when the abnormality detection circuit unit has detected the abnormality.

4 Claims, 3 Drawing Sheets

LIGHT-EMITTING-ELEMENT DRIVING CIRCUIT

CROSS-REFERENCE TO RELATED APPLICATIONS

The entire disclosure of Japanese Patent Application No. 2009-179471 filed on Jul. 31, 2009, including specification, claims, drawings, and abstract, is incorporated herein by reference in its entirety.

BACKGROUND

1. Technical Field

The present invention relates to a light-emitting-element driving circuit, and in particular to a light-emitting-element driving circuit having a voltage boosting circuit unit.

2. Background Art

In recent years, various electronic devices such as a portable phone are equipped with a light-emitting element driving circuit. When the light-emitting-element driving circuit has a voltage boosting circuit unit, the voltage boosting circuit unit boosts the voltage so that a terminal voltage of a light-emitting element becomes a predetermined voltage. With this configuration, light is emitted from the light-emitting element with a desired brightness or the like.

As a technique related to the present invention, for example, Patent Literature 1 (JP 2005-11895 A) discloses, as a light-emitting-element driving circuit, an LED driving circuit which drives an LED with a battery, comprising a constant current circuit which is inserted on a side of an anode or on a side of a cathode of the LED and which controls the current flowing in the LED to a predetermined target value, and a resistor connected to the side of the cathode of the LED and downstream of the constant current circuit. The LED driving circuit further comprises a battery in which a voltage changes according to a remaining capacity within a range including a predetermined voltage value when a sum of a forward direction voltage drop of the LED, a drive voltage of the constant current circuit for the predetermined target value, and a voltage on both ends of the resister for the predetermined target value is the predetermined voltage, and a voltage boosting circuit which is connected between the battery and the LED, which boosts and outputs the battery voltage to a voltage greater than or equal to the predetermined voltage when a switch in the voltage boosting circuit is switched ON, and which outputs the battery voltage without any processing when the switch is switched OFF. The LED driving circuit additionally comprises a control circuit which is connected to the constant current circuit, and which detects a relationship in magnitude between the battery voltage and the predetermined voltage and switches the switch of the voltage boosting circuit ON only when the battery voltage is lower than the predetermined voltage.

In the light-emitting-element driving circuit, a voltage on one terminal of the light-emitting element may be input to the voltage boosting circuit unit as a feedback voltage, and the necessary voltage boosting operation may be executed by the voltage boosting circuit unit. However, when there is an abnormality such as an open failure of the path in a feedback loop path for inputting the voltage on the one terminal of the light-emitting element to the voltage boosting circuit unit as the feedback voltage, a suitable feedback voltage cannot be input, and a protection function of the voltage boosting circuit unit may be activated and the voltage boosting operation may be stopped. Because of this, when there are a plurality of light-emitting elements for which the voltage is to be boosted by the voltage booting circuit unit, there is a problem in that light may not be emitted from light-emitting elements other than the light-emitting element provided in the feedback loop path.

SUMMARY

According to one aspect of the present invention, there is provided a light-emitting-element driving circuit which drives a light-emitting element, comprising a voltage boosting circuit unit which boosts a voltage based on a feedback voltage and which supplies a boosted voltage to a first side terminal of the light-emitting element, a current circuit unit which drives the light-emitting element with a predetermined drive current, a first feedback loop path through which a voltage on a second terminal of the light-emitting element is input as the feedback voltage to the voltage boosting circuit unit, a second feedback loop path which is provided as a backup feedback loop path through which a voltage on the first side terminal of the light-emitting element is input as the feedback voltage to the voltage boosting circuit unit, an abnormality detection circuit unit which compares the feedback voltage which is input to the voltage boosting circuit unit through the first feedback loop path and a predetermined determination voltage, to detect abnormality in the first feedback loop path, and a switching circuit unit which switches from the first feedback loop path to the second feedback loop path when the abnormality detection circuit unit has detected the abnormality.

BRIEF DESCRIPTION OF THE DRAWINGS

A preferred embodiment of the present invention will be described in detail based on the following drawings, wherein.

DESCRIPTION OF EMBODIMENT

Figure 1:
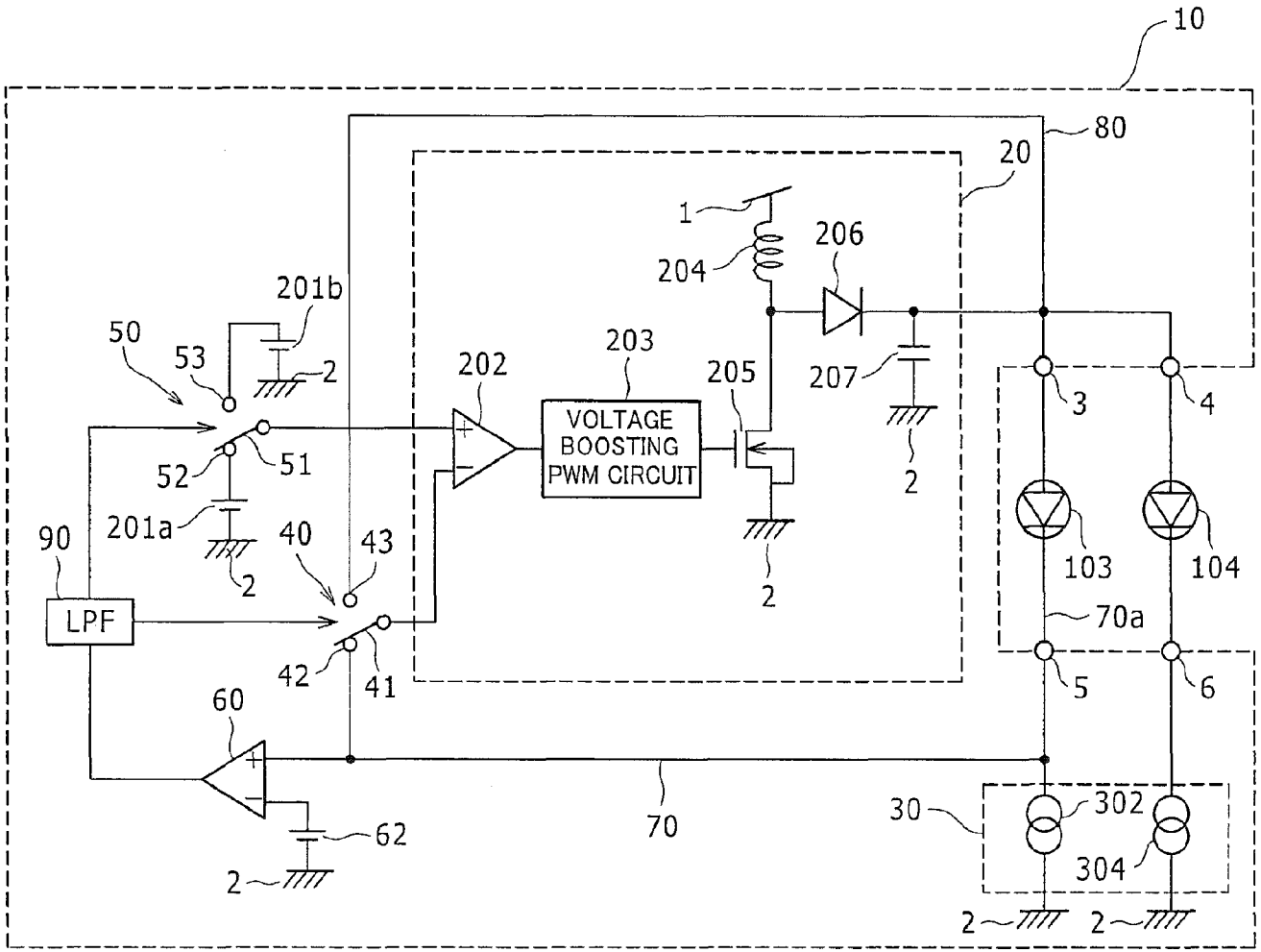
FIG. 1 is a diagram showing a light-emitting-element driving circuit in a preferred embodiment of the present invention.

A preferred embodiment of the present invention will now be described with reference to the attached drawings. In the following description, an LPF (low-pass filter) is described as being formed with an analog filter, but the present invention is not limited to such a configuration, and alternatively, the LPF may be formed with a digital filter.

In the following description, similar elements in all drawings are assigned the same reference numerals and will not be repeatedly described. In the description, the reference numerals which are already described will be referred as necessary.

FIG. 1 is a diagram showing a light-emitting-element driving circuit 10. The light-emitting-element driving circuit 10 comprises a voltage boosting circuit unit 20, a current circuit unit 30, a voltage determining circuit 60, an LPF 90, a negative side switching circuit 40, a positive side switching circuit 50, a normal feedback loop path 70, and a backup feedback loop path 80. The light-emitting-element driving circuit 10 is a circuit which drives light-emitting elements 103 and 104.

First, the light-emitting elements 103 and 104 will be described, and then the constituent elements of the light-emitting-element driving circuit 10 will be described in detail.

The light-emitting elements 103 and 104 are circuit elements which emit light when a voltage is applied in a forward direction between an anode terminal (positive electrode) and a cathode terminal (negative electrode). The light-emitting element 103 has an anode terminal connected to a first terminal 3, and a cathode terminal connected to a second terminal 5. The light-emitting element 104 has an anode terminal connected to a third terminal 4, and a cathode terminal connected to a fourth terminal 6. In addition, the brightness can be changed by changing a current value of the current flowing in the light-emitting elements 103 and 104.

The voltage boosting circuit unit 20 comprises a voltage boosting error amplifier 202, a voltage boosting PWM circuit 203, a voltage boosting transistor 205, a voltage boosting coil 204, a voltage boosting diode 206, and a voltage boosting capacitor 207. The voltage boosting circuit unit 20 has a function to receive, as a feedback voltage, a voltage on the cathode terminal or the anode terminal of the light-emitting element 103, apply a necessary voltage boosting process, and supply the boosted voltage to the anode terminals of the light-emitting elements 103 and 104. The voltage boosting circuit unit 20 is electrically connected to the negative side switching circuit 40, the positive side switching circuit 50, and the anode terminals of the light-emitting elements 103 and 104.

The voltage boosting error amplifier 202 is a circuit which compares a size of two input voltages, and amplifies and outputs a difference between the input voltages. A reference voltage which is input to a positive side input terminal of the voltage boosting error amplifier 202 is connected to the positive side switching circuit 50. A negative side input terminal of the voltage boosting error amplifier 202 is connected to the negative side switching circuit 40 for receiving the feedback voltage from the light-emitting element 103. An output of the voltage boosting error amplifier 202 is input to the voltage boosting PWM circuit 203. The voltage booting error amplifier 202 compares the feedback voltage from the light-emitting element 103 and the reference voltage, and a voltage variation obtained by amplifying the difference in the voltages is output to the voltage boosting PWM circuit 203.

The voltage boosting PWM circuit 203 is a circuit which modulates the input voltage through a modulation method in which a duty ratio of a pulse wave is changed. More specifically, the voltage boosting PWM circuit 203 receives, as an input, the voltage variation which is a comparison result by the voltage boosting error amplifier 202, and changes the duty ratio of the pulse wave based on the voltage variation. The voltage boosting PWM circuit 203 has a function to apply a switching control of the voltage boosting transistor 205 based on the pulse wave corresponding to the voltage variation.

The voltage boosting transistor 205 is an n-channel MOS transistor which controls a current between a source terminal and a drain terminal through a principle of applying a voltage to a gate terminal to form a barrier (gate) in the flow of electrons or holes utilizing an electric field of a channel. Switching of the voltage boosting transistor 205 is controlled by application, on the gate terminal, of a pulse wave which is output from the voltage boosting PWM circuit 203. The voltage boosting transistor 205 has the gate terminal electrically connected to the output of the voltage boosting PWM circuit 203, the drain terminal connected to a second terminal of the voltage boosting coil 204 and an anode terminal of the voltage boosting diode 206, and the source terminal connected to the ground 2 and grounded.

The voltage boosting coil 204 has a first terminal connected to an input power supply voltage 1, and the second terminal connected to the source terminal of the voltage booting transistor 205 and the anode terminal of the voltage boosting diode 206. When the voltage boosting transistor 205 is set to the ON state, the voltage boosting coil 204 is set to a state where the input power supply voltage 1 is applied, and electromagnetic energy is accumulated.

The voltage boosting diode 206 is a circuit element having a rectifying function (a function to allow a current to flow only in a certain direction). In the voltage boosting diode 206, when the voltage boosting transistor 205 is set to the OFF state, the voltage boosting coil 204 in which the electromagnetic energy is accumulated functions similarly as a voltage source, and a current flows to a load through the voltage boosting diode 206. The voltage boosting diode 206 has the anode terminal electrically connected to the second terminal of the voltage boosting coil 204 and the source terminal of the voltage booting transistor 205, and a cathode terminal connected to a positive electrode side terminal of the voltage boosting capacitor.

The voltage boosting capacitor 207 is a circuit element which accumulates or discharges charge (electrical energy) using a capacitance. The voltage boosting capacitor 207 has a function to accumulate charge flowing from the voltage boosting coil 204 when the voltage boosting transistor 205 is set to the OFF state. The voltage boosting capacitor 207 has the positive electrode side terminal electrically connected to the cathode terminal of the voltage boosting diode 206 and the anode terminals of the light-emitting elements 103 and 104, and a negative electrode side terminal connected to the ground 2 and grounded.

The current circuit unit 30 is a circuit which drives the light-emitting elements 103 and 104 with a predetermined drive current. The current circuit unit 30 comprises a constant current source unit 302 and a constant current source unit 304. The constant current source unit 302 has a first terminal connected to the cathode terminal of the light-emitting element 103, a first switch terminal 42 of the negative side switching circuit 40, and a positive side input terminal of the voltage determining circuit 60, and a second terminal connected to the ground 2 and grounded. The constant current source unit 304 has a first terminal connected to the cathode terminal of the light-emitting element 104, and a second terminal connected to the ground 2 and grounded.

The voltage determining circuit 60 outputs a High voltage when the voltage on the positive side input terminal is higher than the voltage on the negative side input terminal, and outputs a Low voltage when the voltage on the positive side input terminal is lower than the voltage on the negative side input terminal. The voltage determining circuit 60 has the positive side input terminal connected to the first switch terminal 42 of the negative side switching circuit 40, the cathode terminal of the light-emitting element 103, and the first terminal of the constant current source unit 302, and the negative side input terminal connected to a determination reference voltage unit 62 which outputs a predetermined determination voltage. An output terminal of the voltage determining circuit 60 is connected to the negative side switching circuit 40 and the positive side switching circuit 50 through the LPF 90.

The LPF 90 is, for example, an analog low-pass filter formed using circuit elements such as a capacitor and a resistor. The LPF 90 is electrically connected to the voltage determining circuit 60, the negative side switching circuit 40, and the positive side switching circuit 50. The LPF 90 has a function to remove high frequency noise in order to prevent erroneous operations of the negative side switching circuit 40 and the positive side switching circuit 50 caused by noise on the output of the voltage determining circuit 60. In this description, the voltage determining circuit 60 and the LPF 90 are collectively referred to as an abnormality detection circuit.

The normal feedback loop path 70 is a path connecting the positive side input terminal of the voltage determining circuit 60, the cathode terminal of the light-emitting element 103, the first terminal of the constant current source unit 302, and the first switch terminal 42 of the negative side switching circuit 40. The normal feedback loop path 70 is a path for feeding back the voltage on the cathode terminal of the light-emitting element 103 to the voltage boosting circuit unit 20. In the normal feedback loop path 70, a path connecting the cathode terminal of the light-emitting element 103 and the second terminal 5 is referred to as a normal feedback loop path 70*a*. The normal feedback loop path 70*a* is provided outside of the light-emitting-element driving circuit 10.

The backup feedback loop path 80 is a path connecting the anode terminals of the light-emitting elements 103 and 104, the cathode terminal of the voltage boosting diode 206, the positive electrode side terminal of the voltage boosting capacitor 207, and a second switch terminal 43 of the negative side switching circuit 40. The backup feedback loop path 80 is a path provided as a backup for feeding back the voltage of the anode terminal of the light-emitting element 103 to the voltage boosting circuit unit 20.

The negative side switching circuit 40 comprises a switch body section 41 connected to the negative side input terminal of the voltage boosting error amplifier 202, the first switch terminal 42 connected to the normal feedback loop path 70, and the second switch terminal 43 connected to the backup feedback loop path 80.

The negative side switching circuit 40 is controlled by the output of the voltage determining circuit 60. More specifically, when the output of the voltage determining circuit 60 is High, the switch body section 41 is connected to the first switch terminal 42, and the negative side input terminal of the voltage boosting error amplifier 202 is connected to the normal feedback loop path 70. When, on the other hand, the output of the voltage determining circuit 60 is Low, the switch body section 41 is connected to the second switch terminal 43, and the negative side input terminal of the voltage boosting error amplifier 202 is connected to the backup feedback loop path 80. The negative side switching circuit 40 also comprises a latch mechanism which maintains, when the output of the voltage determining circuit 60 is switched from High to Low and the switch body section 41 is switched from the first switch terminal 42 to the second switch terminal 43, the state where the switch body section 41 is switched to the second switch terminal 43.

The positive side switching circuit 50 comprises a switch body section 51 connected to the positive side input terminal of the voltage boosting error amplifier 202, a first switch terminal 52 connected to a reference power supply 201*a*, and a second switch terminal 53 connected to a reference power supply 201*b*. The reference power supply 201*a* is a power supply which outputs a cathode terminal reference voltage (for example, 0.5 V) for maintaining the voltage of the cathode terminal of the light-emitting element 103 at a predetermined voltage. The reference power supply 201*b* is a power supply which outputs an anode terminal reference voltage (for example, 4 V) for maintaining the voltage of the anode terminal of the light-emitting element 103 at a predetermined voltage.

The positive side switching circuit 50 is controlled by the output of the voltage determining circuit 60. More specifically, when the output of the voltage determining circuit 60 is High, the switch body section 51 is connected to the first switch terminal 52, and the positive side input terminal of the voltage boosting error amplifier 202 is connected to the reference power supply 201*a*. When, on the other hand, the output of the voltage determining circuit 60 is Low, the switch body section 51 is connected to the second switch terminal 53, and the positive side input terminal of the voltage boosting error amplifier 202 is connected to the reference power supply 201*b*. The positive side switching circuit 50 also comprises a latch mechanism which, when the output of the voltage determining circuit 60 is switched from High to Low and the switch body section 51 is switched from the first switch terminal 52 to the second switch terminal 53, maintains the state when the switch body section 51 is switched to the second switch terminal 53.

Next, an operation of the light-emitting-element driving circuit 10 having the above-described structure will be described with reference to FIG. 1. In the light-emitting-element driving circuit 10, when there is no abnormality in the normal feedback loop path 70*a*, the voltage which is input to the positive side input terminal of the voltage determining circuit 60 is higher than the predetermined determination voltage which is input to the negative side input terminal of the voltage determining circuit 60, and thus the output of the voltage determining circuit 60 is High. Because of this, the switch body section 41 of the negative side switching circuit 40 is connected to the first switch terminal 42, and the switch body section 51 of the positive side switching circuit 50 is connected to the first switch terminal 52. The terminal voltage of the cathode terminal of the light-emitting element 103 is input as the feedback voltage to the negative side input terminal of the voltage boosting error amplifier 202, the cathode terminal reference voltage which is output from the reference power supply 201*a* is input to the positive side input terminal of the voltage boosting error amplifier 202, and the voltage boosting error amplifier 202 amplifies and outputs a difference between these two input voltages. In addition, the voltage boosting PWM circuit 203 calculates a predetermined duty ratio based on the output of the voltage boosting error amplifier 202, and the switching of the voltage boosting transistor 205 is controlled based on the duty ratio. In this manner, the output of the voltage boosting circuit unit 20 can be boosted to a necessary voltage, and the boosted voltage can be supplied to the anode terminal of the light-emitting element 103.

Next, when there is abnormality in the normal feedback loop path 70*a*, for example, when the normal feedback loop path 70*a* is disconnected from the second terminal 5 (that is, when there is an open failure), no current would flow in the constant current source unit 302, and the voltage which is input to the positive side input terminal of the voltage determining circuit 60 becomes approximately 0. Therefore, the voltage which is input to the positive side input terminal of the voltage determining circuit 60 is a value which does not exceed the predetermined determination voltage which is input to the negative side input terminal of the voltage determining circuit 60, and thus the output of the voltage determining circuit 60 becomes Low. As a result, the switch body section 41 of the negative side switching circuit 40 is switched and connected to the second switch terminal 43, and the switch body section 51 of the positive side switching circuit 50 is switched and connected to the second switch terminal 53. The terminal voltage of the anode terminal of the light-emitting element 103 is input as the feedback voltage to the negative side input terminal of the voltage boosting error amplifier 202, the anode terminal reference voltage which is output from the reference power supply 201*b* is input to the positive side input terminal of the voltage boosting error amplifier 202, and the voltage boosting error amplifier 202 amplifies and outputs a difference between these two input voltages. In addition, the voltage boosting PWM circuit 20 calculates a predetermined duty ratio based on the output of the voltage boosting error amplifier 202, and the switching of the voltage boosting transistor 205 is controlled based on the duty ratio. In this manner, the output of the voltage boosting circuit unit 20 can be boosted to a necessary voltage, and the boosted voltage can be supplied to the anode terminal of the light-emitting element 103.

As described above, with the light-emitting element driving circuit 10, at normal times, the voltage of the cathode terminal of the light-emitting element 103 is input to the voltage boosting circuit unit 20 as the feedback voltage, and a necessary voltage boosting operation is executed in the voltage boosting circuit unit 20. For example, even when there is an open failure in the normal feedback loop path 70*a* of the light-emitting element 103, the path is switched from the normal feedback loop path 70 to the backup feedback loop path 80, so that the voltage of the anode terminal of the light-emitting element 103 is input to the voltage boosting circuit unit 20 as the feedback voltage, and a necessary voltage boosting operation is executed at the voltage boosting circuit unit 20. Therefore, even when an open failure occurs in the normal feedback loop path 70*a* and a failure state occurs in which light is not emitted from the light-emitting element 103, activation of the protection function of the voltage boosting circuit unit 20 can be avoided (that is, the voltage boosting operation can be prevented from being stopped), the voltage of the anode terminal of the light-emitting element 103 can be input as the feedback voltage to the voltage boosting circuit unit 20, and the necessary voltage boosting operation can be executed, resulting in an advantage that the light-emitting element 104 which is the other light-emitting element can normally emit light. Because the negative side switching circuit 40 and the positive side switching circuit 50 of the light-emitting-element driving circuit 10 have latch mechanisms for maintaining the states when the switch body sections are switched to the second switch terminal 43 and the second switch terminal 53, respectively, it is possible to prevent a phenomenon of sequential switching of the switch body section when the contact state is such that the normal feedback loop path 70*a* transitions back and forth between the normal state and the open state.

In the above description, the voltage boosting circuit unit 20 is described as a voltage booting circuit which uses the voltage boosting error amplifier 202, the voltage boosting PWM circuit 203, and the voltage boosting coil 204, etc., but the present invention is not limited to such a configuration, and alternatively the voltage boosting circuit unit 20 may be a switching power supply which outputs a stable boosted voltage by ON-OFF control of a switching element, or a charge pump circuit which outputs a boosted voltage by switching connection states of a plurality of capacitors with a plurality of switches.

Figure 2:
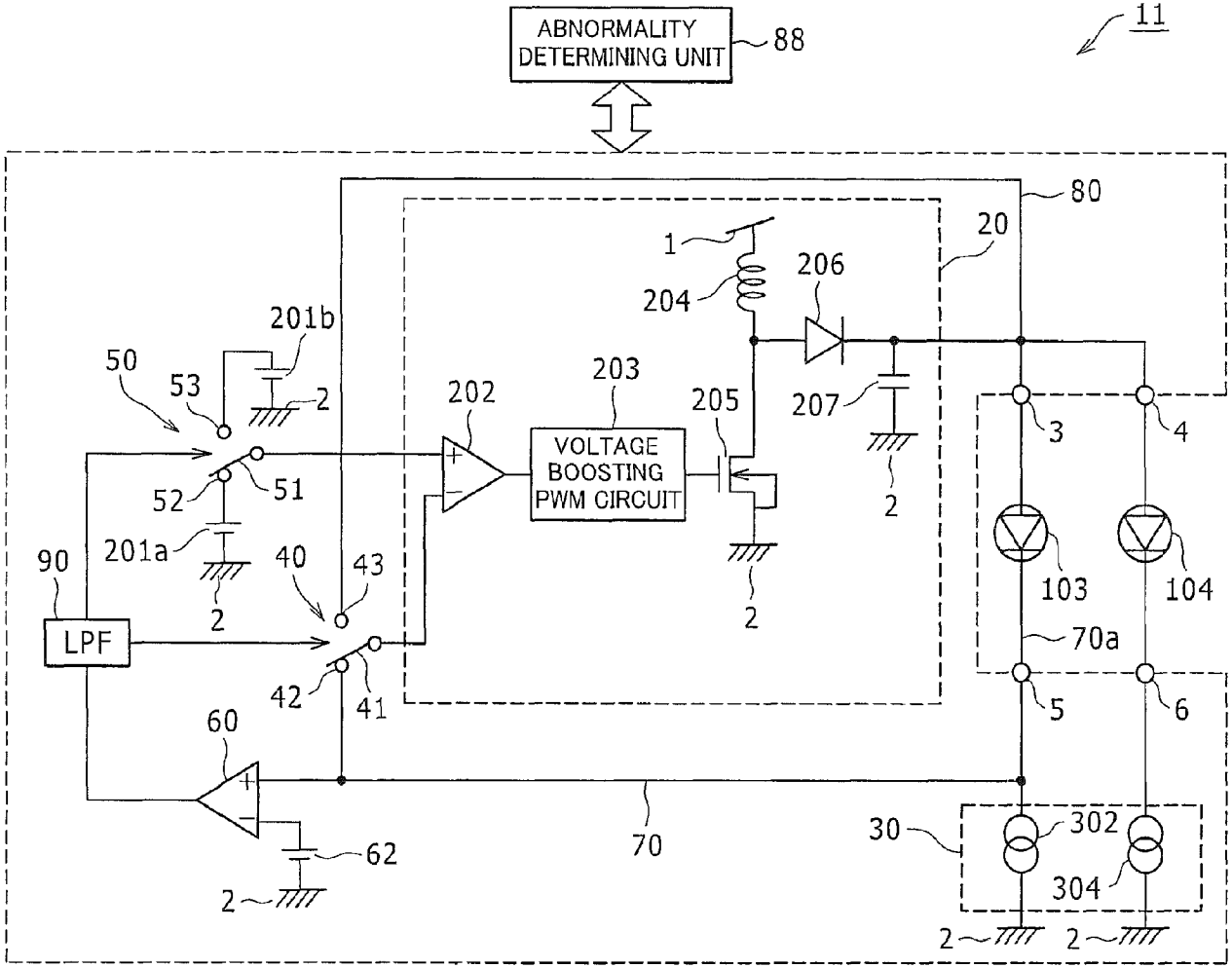
FIG. 2 is a diagram showing an alternative configuration of the light-emitting-element driving circuit in the preferred embodiment of the present invention.

Next, a light-emitting-element driving circuit 11 which is an alternative configuration of the light-emitting-element driving circuit 10 will be descried. FIG. 2 is a diagram showing the light-emitting element diving circuit 11. A difference between the light-emitting-element driving circuit 11 and the light-emitting-element driving circuit 10 is in an abnormality determining unit 88, and thus the abnormality determining unit 88 will be primarily described.

The abnormality determining unit 88 has a function to determine whether a path failure of the normal feedback loop path 70*a* is an open failure (for example, a state where the feedback loop path 70*a* is disconnected from the second terminal 5) or a short-circuit failure (for example, a state where the feedback loop path 70*a* is grounded).

The abnormality determining unit 88 does not allow the switching of the negative side switching circuit 40 and the positive side switching circuit 50 and maintains the connection state between a time when the output of the voltage determining circuit 60 becomes the Low state until a first period (for example, 5 msec) is elapsed. When the first period has elapsed, the negative side switching circuit 40 and the positive side switching circuit 50 are switched to the second switch terminal 43 and the second switch terminal 53, respectively. Then, after a second period (for example, 10 msec) has elapsed, if the output of the voltage boosting circuit unit 20 is a desired boosted voltage, the abnormality determining unit 88 determines that the failure is the open failure, and, if the output of the voltage boosting circuit unit 20 is still in the state of a forward voltage (Vf) of the light-emitting element 103, the abnormality determining unit 88 determines that the failure is the short-circuit failure.

Figure 3A:
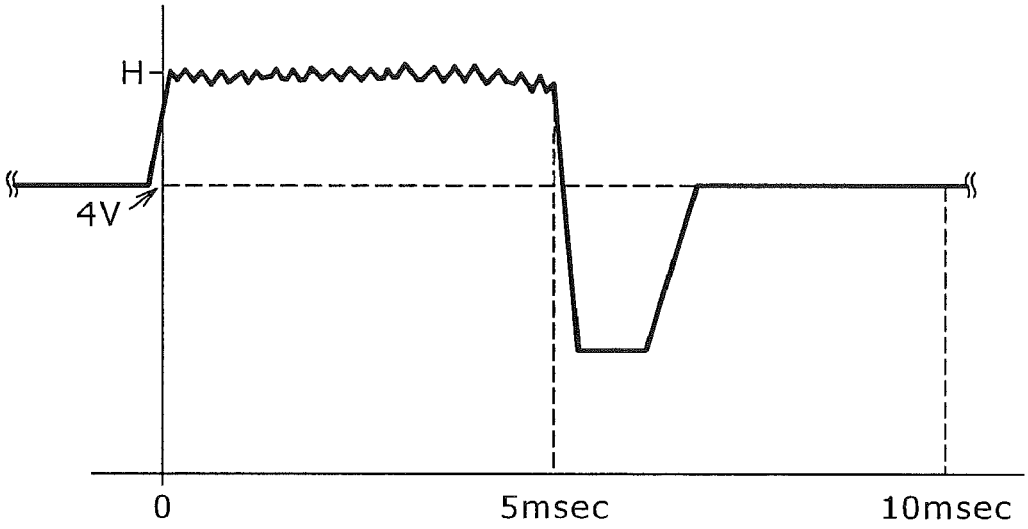
FIG. 3A is a diagram showing a voltage characteristic when there is an open failure in a normal feedback loop path in the preferred embodiment of the present invention.
Figure 3B:
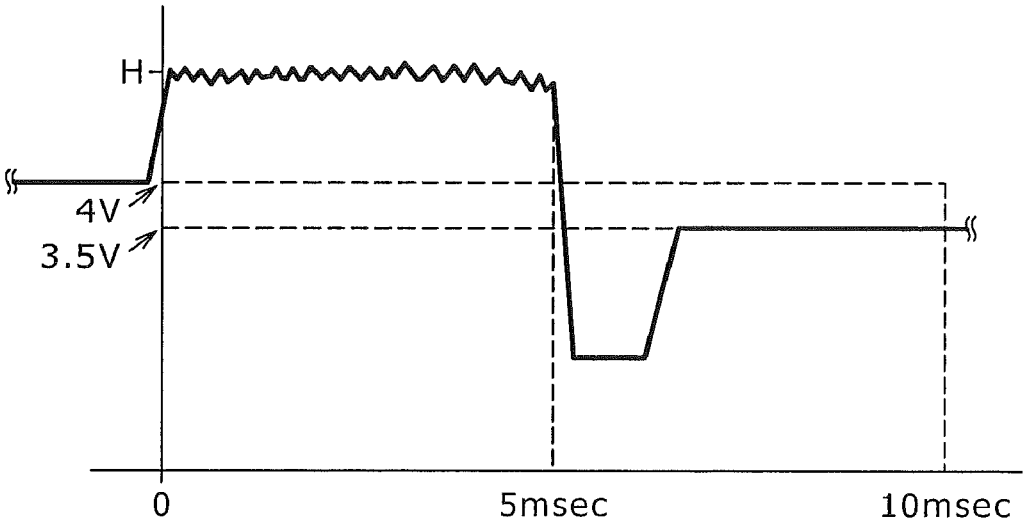
FIG. 3B is a diagram showing a voltage characteristic when there is a short-circuiting failure in the normal feedback loop path in the preferred embodiment of the present invention.

Next, an operation of the light-emitting-element driving circuit 11 having the above-described structure will be descried with reference to FIGS. 2, 3A, and 3B. FIG. 3A is a diagram showing a voltage characteristic when there is the open failure in the normal feedback loop path 70*a*. FIG. 3B is a diagram showing a voltage characteristic when there is the short-circuit failure in the normal feedback loop path 70*a*. A time when the failure occurs in the feedback loop path 70*a* in the light-emitting-element driving circuit 11 is set in FIGS. 3A and 3B as a reference time which is at 0. At this point, because a voltage of approximately 0 is input to the negative side input terminal of the voltage boosting error amplifier 202, the output of the voltage boosting circuit unit 20 is increased from around 4V to around H (upper limit value), as shown in FIGS. 3A and 3B. After the first period which is 5 msec (5 milliseconds) has elapsed while this state is maintained, the negative side switching circuit 40 and the positive side switching circuit 50 are switched to the second switch terminal 43 and the second switch terminal 53, respectively. In this manner, the path is switched from the normal feedback loop path 70 in which failure has occurred to the backup feedback loop path 80 in which there is no failure.

Here, when the failure of the normal feedback loop path 70*a* is the open failure, as shown in FIG. 3A, when the path is switched to the backup feedback loop path 80, a normal voltage boosting operation is restored, and thus when the second period which is 10 msec (10 milliseconds) has elapsed, the output of the voltage boosting circuit unit 20 is at a normal boosted voltage (voltage of the cathode terminal of the light-emitting element 104 (0.5 V)+forward voltage Vf (3.5 V) of the light-emitting element 104=4 V).

On the other hand, when the failure of the normal feedback loop path 70*a* is the short-circuit failure, the voltage of the cathode terminal of the light-emitting element 103 is still at 0 even when the path is switched to the backup feedback loop path 80 as shown in FIG. 3B, and thus when the second period which is 10 msec (10 milliseconds) has elapsed, the output of the voltage boosting circuit 20 is at an abnormal boosted voltage (forward voltage Vf (3.5 V) of the light-emitting element 103=3.5 V). Therefore, with the light-emitting-element driving circuit 11, it is possible to determine whether the failure of the normal feedback loop path 70*a* is the open failure or the short-circuit failure by determining whether the voltage boosting circuit unit 20 outputs a normal boosted voltage or an abnormal boosted voltage after 10 msec (10 milliseconds) has elapsed, as shown in FIGS. 3A and 3B. The above-described voltage values are merely exemplary, and alternatively other voltage values may be used.

Alternatively, a control may be applied where, when it is determined that the failure of the normal feedback loop path 70*a* is the short-circuit failure, the abnormality determining unit 88 stops the voltage boosting operation of the voltage boosting circuit unit 20, as a protection function of the voltage boosting circuit unit 20.

In the above description, the detection of the short-circuit failure is described to be targeted to the short-circuit failure of the normal feedback loop path 70, but alternatively, the short-circuit failure in other paths in the light-emitting-element driving circuit 11 may be detected.

What is claimed is:

1. A light-emitting-element driving circuit which drives a light-emitting element, comprising:

a voltage boosting circuit unit which boosts a voltage based on a feedback voltage and which supplies a boosted voltage to a first side terminal of the light-emitting element;

a current circuit unit which drives the light-emitting element with a predetermined drive current;

a first feedback loop path through which a voltage on a second side terminal of the light-emitting element is input as the feedback voltage to the voltage boosting circuit unit;

a second feedback loop path which is provided as a backup feedback loop path through which a voltage on the first side terminal of the light-emitting element is input as the feedback voltage to the voltage boosting circuit unit;

an abnormality detection circuit unit which compares the feedback voltage which is input to the voltage boosting circuit unit through the first feedback loop path and a predetermined determination voltage, to detect abnormality in the first feedback loop path; and a switching circuit unit which switches from the first feedback loop path to the second feedback loop path when the abnormality detection circuit unit has detected the abnormality.

2. The light-emitting-element driving circuit according to claim 1, further comprising:

a determination unit which determines that the abnormality of the first feedback loop path is an open path when the voltage boosting circuit unit outputs an arbitrary boosted voltage after a predetermined period has elapsed from the switching from the first feedback loop path to the second feedback loop path, and which determines that the abnormality of the first feedback loop path is short-circuit of the path when the voltage boosting circuit unit does not output the arbitrary boosted voltage after the predetermined period has elapsed from the switching from the first feedback loop path to the second feedback loop path.

3. The light-emitting-element driving circuit according to claim 1, wherein the abnormality detection circuit unit comprises a filter circuit which filters a comparison result between the feedback voltage which is input through the first feedback loop path to the voltage boosting circuit unit and the predetermined determination voltage.

4. The light-emitting-element driving circuit according to claim 1, wherein the switching circuit unit comprises a maintaining unit which maintains the state of the switching from the first feedback loop path to the second feedback loop path when the abnormality detection circuit unit has detected the abnormality.

* * * * *